United States Patent [19]

Abd. El Halim

[11] Patent Number: 4,737,050

[45] Date of Patent: Apr. 12, 1988

[54] METHOD FOR COMPACTING ASPHALT

[76] Inventor: Omar A. Abd. El Halim, 110 Theresa Private, Ottawa, Ontario, Canada, K1V 0E7

[21] Appl. No.: 16,693

[22] Filed: Feb. 19, 1987

Related U.S. Application Data

[62] Division of Ser. No. 748,634, Jun. 25, 1985, Pat. No. 4,661,011.

[30] Foreign Application Priority Data

Apr. 26, 1985 [CA] Canada ..... 480187

[51] Int. Cl.[4] ..... E01C 19/26

[52] U.S. Cl. ..... 404/75; 404/117

[58] Field of Search ..... 404/72, 75, 117, 122, 404/123, 124, 126; 305/21, 24, 35 EB, 34, 38; 180/20

[56] References Cited

U.S. PATENT DOCUMENTS

| | | | |
|---|---|---|---|
| 855,510 | 6/1907 | Heroult | 305/38 |
| 3,009,401 | 11/1961 | Greiner | 404/123 |
| 3,422,735 | 1/1969 | Vitry | 404/123 |
| 3,696,878 | 10/1972 | Nelson | 305/35 EB |
| 3,832,079 | 8/1974 | Moorhead | 404/72 |
| 3,945,748 | 3/1976 | Berrange | 404/117 |
| 3,958,892 | 5/1976 | Bosslet et al. | 404/123 |
| 4,088,077 | 5/1978 | von Beckmann | 404/117 |
| 4,124,325 | 11/1978 | Cutler | 404/75 |
| 4,647,247 | 3/1987 | Sandström | 404/75 |

FOREIGN PATENT DOCUMENTS

| | | | |
|---|---|---|---|
| 1921323 | 11/1970 | Fed. Rep. of Germany | 180/20 |
| 0151835 | 3/1932 | Switzerland | 305/24 |

*Primary Examiner*—James A. Leppink
*Assistant Examiner*—Terry Lee Melius
*Attorney, Agent, or Firm*—Millen & White

[57] ABSTRACT

For the formation of a substantially crack-free paved surface, pressure is applied to a layer of asphalt substantially simultaneously by means of longitudinally-spaced-apart, rollingly-movable pressure areas and by means of substantially continuously applied pressure to substantially the entire bottom inner area of a flat, endless, elastomeric belt extending between the two longitudinally-spaced-apart, rollingly-movable areas, whereby the continuously applied pressure is transferred to substantially the entire bottom outer area of the endless elastomeric belt which extends between the two longitudinally-spaced-apart, rollingly-movable areas.

7 Claims, 1 Drawing Sheet

METHOD FOR COMPACTING ASPHALT

This is a division of application Ser. No. 748,634, filed June 25, 1985, now U.S. Pat. No. 4,661,011.

BACKGROUND OF THE INVENTION

1. Field of the Invention

The present invention relates to compaction equipment, and more particularly to a roller of the type used in compacting surfacing materials, e.g. asphalt, for roads and the like.

2. Description of the Prior Art

In present day road building practice, when compacting certain types of road building materials, it was empirically thought that care must be taken to see that the material was not overloaded on the first pass of the roller. Hence, it was thought that the pressure exerted on the material by the first roll of the road roller to pass thereover should not exceed that overload point for the material if best results were to be obtained. At the same time, it was thought that it was desirable to approach the overload pressure as closely as possible without exceeding it, in order to compact the material to the maximum possible degree on the first pass of the roller. The overload pressure of the various materials used in the building of roads varied with the particular material being rolled, and hence it was thought to be desirable to be able to vary the pressure applied by the leading roll of the road roller so as to cause it to apply a pressure which closely approached, but did not exceed, this overload pressure of the material.

The conventional two-axle tandem road roller was not always able to meet the requirements imposed by the various types of road building materials since the load distribution on the rolls of this type of roller was fixed, usually in the ratio of 2:1, i.e. the pressure applied by the drive roll was twice the pressure applied by the guide roll. It was therefore thought to be desirable to be able to control the pressures applied by the several rolls of a road roller in various ways in order best to adapt the machine to the particular material being compacted, and to enable maximum densification of the material to be achieved by the fewest number of passes of the roller.

One proposed solution to the problem of eliminating ridges or ripples in the pavement was said to be solved by L. A. Poujard in U.S. Pat. No. 1,749,647 which used rollers mounted on an axle normally deflected with reference to a plane perpendicular to the normal path of the machine.

In the use of the conventional two-axle tandem roller, a uniform high density was achieved, but bumps caused by non-uniform thickness of the road-bed material and by unevenness of the base course, were perpetuated. It was customary, therefore, to resort to cross-rolling to reduce bumps. This was unsatisfactory inasmuch as the material had by this time set, and the lateral displacement of material which was necessary to reduce the bumps was difficult to attain. Any reduction of the bumps is done by increasing the density of the "semi-reduced" bumps which results in uneven densities in the pavement.

To overcome these problems of the two-axle tandem roller, the so-called three-axle tandem roller was devised. One such three-axle machine, shown in Greiner U.S. Pat. No. 2,015,891, dated Oct. 1, 1935, was customarily so built that, with all three rolls in contact with a plane surface, the roller approximates a two-axle tandem roller with an extra guide roll. That is, the ground reaction of each guide roll was one-half the ground reaction to the drive roll.

U.S. Pat. No. 2,132,059, issued Oct. 4, 1938, to George E. Trembly disclosed a three-axle road roller in which it was possible to adjust the relative elevations of the axles so that the rolls of the machine may be made to follow any desired road counter, that is, either a flat surface, a concave surface, or a convex surface. It was also said to be possible, in the Trembly roller, selectively to elevate either the center roll or one of the end rolls off the ground, thereby to cause different pressures to be applied by the rolls to the surface being rolled. This expedient, however, enabled only two optional pressure distributions on the rolls to be effected, neither of which could always fully satisfy the requirements of the particular material being rolled.

Canadian Pat. No. 563,757 issued Sept. 23, 1955, to John F. Harrison provided a three-axle roller in which free vertical flotation of both guide rolls was provided when desired or required, and continuous weight equalization was maintained between the two guide rolls when they were thus simultaneously released for vertical flotation. Further, either guide roll could be fixedly raised above the tangent plane of the rolls, thus providing the exact weight ratio characteristics of a conventional two-axle roller when desired, plus the characteristics of a two-axle roller in which the weight on both the drive roll and the guide roll was the same.

Canadian Pat. No. 579,559 issued July 14, 1959, tc Carl F. Greiner provided a road roller having three or more rolls arranged in tandem, having a pressure control device for enabling infinitely variable pressures to be applied by the rolls to the surface being rolled, and in which one of the guide rolls was mounted for vertical displacement relative to the frame.

Canadian Pat. No. 597,717 issued May 10, 1960 to John F. Harrison provided a self-propelled road roller comprising a frame, a drive roll and a plurality of guide rolls arranged in tandem on the frame means for supporting at least one of the guide rolls for vertical displacement relative to the other rolls. Means connected between the frame and the supporting means were provided for applying a downward pressure on one guide roll in opposition to the reaction force exerted thereon by the surface being rolled. Means for adjusting the pressure applying means were provided to control the downward pressure exerted thereby on one guide roll whereby the proportion of the total weight of the roller carried by one guide roll may be selected as desired and maintained constant during rolling operations. Finally means were provided for positively limiting the upward movement of the one guide roll.

Asphalt paving machines are also known which utilize crawler-type tracks for flotation and mobility but not for compaction. Canadian Pat. No. 956,341 issued Oct. 15, 1974 to Donald R Davin et al, is one example of such machine in which the crawler track arrangement, including the track per se and the means for supporting and driving it, provided a high degree of flotation effectiveness, to prevent unduly marking previously laid pavement courses, and propelled the paving machine at adequate paving and traveling speeds.

U.S. Pat. No. 4,231,678 patented Nov. 4, 1980 by F. E. Carterrock is another example of such machine having a tracked undercarriage supporting the paving machine.

Certain facets of compaction equipment have features in common with vehicles for moving loads on difficult terrain, or for compacting soil. U.S. Pat. No. 2,714,011 issued July 26, 1955 to W. H. Albee is concerned with the former problem. That problem was said to be solved in a load moving vehicle comprising an axially elongated, flexible-walled, fluid-distensible roller for supporting the weight of a load applied to its outer surface for transportation of the load thereon. The roller included journal means of which the axis is the axis of the roller, a load-sustaining structure and removable means journaled on that structure and running upon the outer surface of the roller for applying the weight of the laod to the roller. Horizontal propulsion means were provided which had a connection to the structure and associated with the journal means for relative rotation of the two for sustaining horizontal propulsion force.

The latter problem was addressed in U.S. Pat. No. 3,603,226 patented Sept. 7, 1971 by J. Marcovitch which taught a road roller having small diameter ground engaging rolls rolling around a cylindrical backup roll located at the front of the road roller.

Another suggested solution to this problem was said to be provided in U.S. Pat. No. 3,945,748, issued Mar. 23, 1976, to Aubrey R. Berrage. In that patent, a method of soil compaction was provided by the applying, during compaction of the soil, of a smaller auxiliary force around the area of the soil to which a larger compacting force is applied. In soil compacting apparatus, a pneumatic tire was used for applying the auxiliary force and the compacting force was applied by a cylindrical or non-cylindrical compacting member located within the tire. The compacting member was adapted to compact the inner surface of the soil. A pneumatic tire, when in contact with a soil surface applied a pressure to the soil approximately equivalent to the inflation pressure of the tire. By using a "balloon" type of tire, a large area of soil was confined by the air pressure. Thus, the auxiliary force applying means may comprise a pneumatic tire. The compacting force applying means may comprise a cylindrical compacting member located inside or adjacent to the tire.

SUMMARY OF THE INVENTION

Aims of the Invention

While the prior art has confronted the uneven compaction problem with varying degrees of success, a significant problem which has not been adequately addressed is that of cracking of the asphalt. Cracks in the pavement are the forerunner of the dreaded pothole. It is believed that a pothole occurs when water seaps into cracks in a road surface, freezes and expands the pavement. When the ice melts the pavement is shattered by vehicle running thereover.

It has unexpectedly been found by the present inventor that cracks in an asphalt pavement are brought about largely at the time of compaction by the compactors used in compacting the asphalt. At the present time, the ratio between the stiffness of the compactor ($E_1$) to the stiffness of the asphalt ($E_2$) is high. On the other hand, the present inventor believes that $E_1/E_2$ should be made as low as possible.

In addition, at the present time, the ratio between the radius of the compactor drum ($R_1$) to the radius of curvature of the compacted asphalt ($R_2$) is low. On the other hand, it is believed by the present inventor that $R_1/R_2$ should be 1, or as close to 1, as possible.

In order to attempt to meet these two apparently contradictory prerequisites, the inventor has previously attempted two stategies: firstly, to place sand over the newly-laid asphalt before compaction; or secondly to place a sheet of rubber over the newly-laid asphalt before compation.

These techniques were found to be successful, but they are less attractive economically than the invented compaction machine to be described hereinbelow.

An object therefore of the present invention is to provide an asphalt compaction method which leaves a paved surface which is not only even and substantially bump-free, but which also is substantially crack-free.

Statement of Invention

The inventor has found that many of the problems of the prior art can be solved by means of a moving, flat, resilient, pressure-applying surface to compact the newly-laid asphalt. Accordingly, by one aspect of this invention a method is provided comprising applying pressure to a layer of asphalt by two procedures substantially simultaneously. One procedure applies pressure through two longitudinally-spaced-apart, rollingly-movable areas. The other procedure applies pressure to the asphalt by applying pressure, substantially continuously, to substantially the entire bottom inner area of a flat endless, elastomeric belt which extends between the two longitudinally-spaced-apart, rollingly-movable areas. The pressure applied to the bottom inner area of the belt is transferred to substantially the entire bottom area of the belt. The two rollingly-movable areas are entrained by the endless belt.

The present invention also provides an improvement in a method for compacting asphalt in which hot asphalt is spread on a packed roadbed material and is then compacted by means of rolling pressure applied to the asphalt. The improvement comprises applying pressure to the layer of asphalt substantially simultaneously by the two procedures of (a) applying pressure to two longitudinally-spaced-apart, rollingly-movable areas, and (b) substantially continuously applying pressure to substantially the entire bottom inner area of a flat, endless, elastomeric belt extending between the two longitudinally-spaced-apart, rollingly-movable, applied pressure areas, that continuously-applied pressure being transferred to substantially the entire bottom outer area of the endless elastomeric belt which extends between the two longitudinally-spaced-apart, rollingly-movable applied pressure areas.

Other Features of the Invention

One further feature of this invention resides in an improved method for compacting asphalt in which hot asphalt is spread onto a packed roadbed material and is then compacted by means of applying pressure to the asphalt. The improvement comprises entraining a flat, endless, elastomeric belt around at least two longitudinally-spaced-apart rollers; applying continuous pressure to the asphalt, substantially simultaneously by the two procedures of applying pressue through the longitudinally-spaced-apart rollers to the outer areas of the rollers where such rollers are entrained by the endless, elastomeric belt, and continuously applying pressure to substantially the entire bottom inner area of the endless elastomeric belt which extends between the longitudinally-spaced-apart rollers, that pressure being transferred to substantially the entire bottom outer area of the endless belt which entrains the longitudinally-spaced-apart rollers and which is moved in intimate contact with the asphalt, whereby the asphalt is formed into a paved surface which is substantially crack-free.

Another further feature of this invention resides in an improved method for compacting asphalt in which hot asphalt is spread onto a packed roadbed material and is then compacted by means of applying pressure to the asphalt. The improvement comprises applying pressure to the asphalt by application of pressure to the bottom outer area of a moving, endless, elastomeric belt entraining a pair of longitudinally-spaced-apart, tandem, rigid drums. Pressure is applied substantially simultaneously at the lower areas where the belt entrains the drums, through the drums, and at substantially the entire inner bottom surface of the belt which extends between the two, longitudinally-spaced-apart rigid drums. The pressure is transferred to substantially the entire outer bottom area of the belt which entrains the rigid drums, thereby pressing substantially the entire bottom outer surface of the belt into pressure contact with the asphalt being compacted.

The drums preferably are each rotatable on an axle, the two axles being mounted between a pair of longitudinally-extending members. Furthermore, the drums may each be provided with peripheral rims to guide the rubber belt on the rigid drums between the rims.

The elastomeric belt is preferably a laminated rubber belt, consisting essentially of an outer compaction layer and an inner, drum-contacting lamination, the outer layer being harder than the inner layer. The drums preferably are hollow steel drums and the thickness of the shell of each drum is preferably one-third of the thickness of the rubber belt.

BRIEF DESCRIPTION OF THE DRAWINGS

In the accompanying drawings.

DESCRIPTION OF PREFERRED EMBODIMENTS

Figure 1:
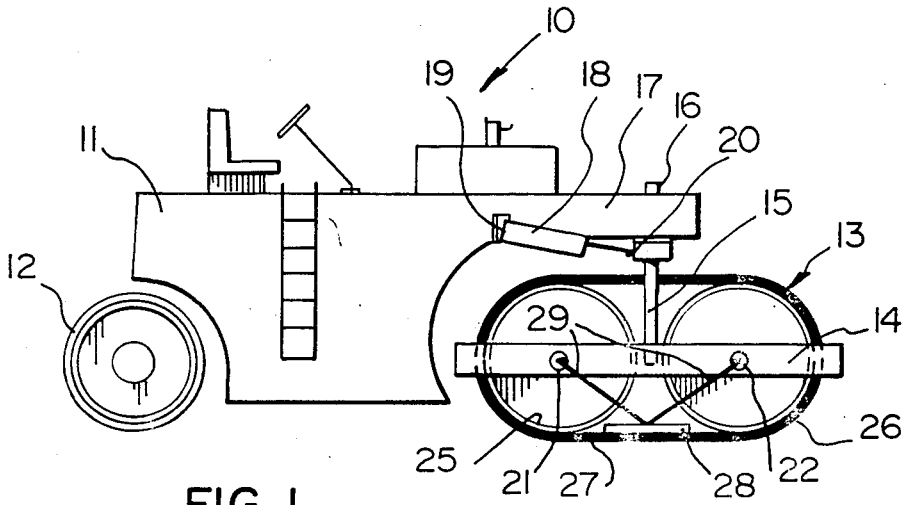
FIG. 1 is a schematic side-elevational representation of one embodiment of the asphalt compactor of one embodiment of the present invention.
Figure 2:
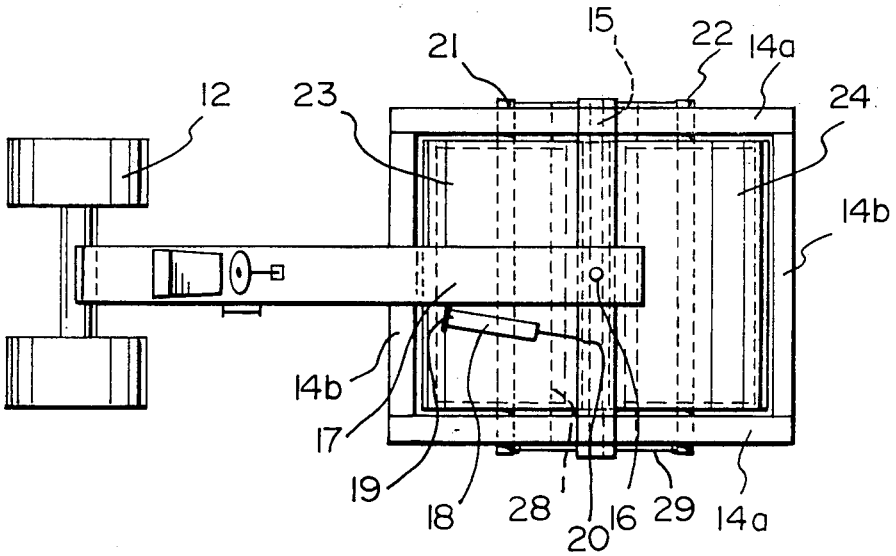
FIG. 2 is a top plan view of the embodiment of FIG. 1.

As seen in the drawings, the compactor 10 includes a main chassis 11 supported at the rear end by a traction roller, e.g. a pair of drive rubber-tired wheels 12, and at the other end by a steerable, rolling, compaction mechanism 13 of an embodiment of this invention to be described in greater detail hereinafter. The mechanism 13 is supported by a rectangular framework 14 which is connected to a steering jack 15, which in turn, is rotatably connected by a central trunnion 16 to the forward end of a centelevered gooseneck 17. Steering is provided by hydraulic steering cylinder 18 connected at one end 19 to an inner end of gooseneck 17 and at its opposite, piston end 20 to yoke 15 at a position offset from trunnion 16. While FIG. 1 shows one way of steerably attaching the mechanism 13 to the connector chassis, this means of attachment does not form the essence of the present invention. Any other alternative construction, well known to those skilled in the art may be used.

Mechanism 13 includes a rectangular frame 14, composed of longitudinal frame members **14*a* and tranverse frame members 14*b*. Freely-rotatably mounted in axles 21, 22 between frames 14*a* are hollow steel drums 23, 24. Drums 23, 24 are each provided with lateral rims 25. Between lateral rims 25 and entraining drums 23, 24 is resilient, asphalt-compaction belt 26. Resilient belt 26 is preferably a laminated rubber belt having a harder outer layer to contact the asphalt and a softer inner layer which contacts the steel drum 23, 24. This type of belt used as a traction belt is well known to those skilled in the art. Within the above characteristics of the laminated rubber belt, the elasticity thereof should fall within the range of less than that of the steel roller, while being as close as possible to that of the asphalt. It is preferred that the thickness of belt 26 be three times the thickness of the steel shell forming the hollow drums 23, 24**.

It is preferred that the flat portion 27 of belt 26 between drums 23, 24 be held in firm pressure contact with the asphalt being compacted. This may be done, as shown, by the provision of a pressure plate 28, held in sliding contact with the inner layer of belt 26 by means of braces 29.

EFFECT OF PREFERRED EMBODIMENT

In tests using an asphalt compactor build according to the principles of aspects of this invention, it was found by visual inspection that newly-compacted asphalt had substantially no cracks on its surface. On the other hand, in tests using asphalt compactors built according to the prior art, it was found by visual inspection that newly compacted asphalt had a significant number of cracks on its surface.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. In a method for compacting asphalt in which hot asphalt is spread onto a packed roadbed material and is then compacted by means of pressure on said asphalt, the improvement comprising: applying said pressure substantially simultaneously by a first procedure and a second procedure; said first procedure involves applying pressure at two longitudinally-spaced-apart, rollingly-movable areas by applying said pressure to the bottom inner area of a moving, endless, elastomeric belt entraining a pair of longitudinally-spaced-apart, tandem, rigid drums, at lower areas where said belt entrains said drums, said pressure being applied to said lower areas through said drums; said second procedure involves applying pressure to substantially the entire inner bottom surface of said belt which extends between said two longitudinally-spaced-apart, rigid drums; and transferring said pressure to substantially the entire outer bottom area of said belt which entrains said rigid drums, thereby pressing substantially the entire outer bottom surface of said belt into pressure contact with said asphalt.

2. The method of claim 1 wherein the following relationships are provided:

$E_1/E_2$ approaches 1, wherein $E_1$ is the stiffness of the elastomeric belt and $E_2$ is the stiffness of the asphalt; and $R_1/R_2$ approaches 1, wherein $R_1$ is the radius of curvature of the elastomeric belt and $R_2$ is the radius of curvature of the compacted asphalt.

3. A method according to claim 1 wherein said elastomeric belts consists essentially of an outer compaction layer which is in contact with the asphalt to be compacted and an inner drum-contacting layer, said outer layer being harder than said inner layer.

4. A method according to claim 1 wherein said tandem rigid drums are hollow steel drums.

5. A method according to claim 4 wherein said hollow steel drums have a thickness which is about one-third the thickness of said elastomeric belt.

6. A method according to claim 1 wherein said elastomeric belt has an elasticity which is less than that of the rigid drums.

7. In a method for compacting asphalt in which hot asphalt is spread onto a packed roadbed material and is then compacted by means of pressure on said asphalt, the improvement comprising:

entraining a flat, endless elastomeric belt around at least two longitudinally-spaced-apart rollers; applying continuous pressure to said asphalt substantially simultaneously by a first procedure and a second procedure; said first procedure involves applying pressure through said longitudinally-spaced-apart rollers to the outer areas of said rollers where said rollers are entrained by said endless, elastomeric belt; and said second procedure involves continuously applying pressure to substantially the entire bottom inner area of said endless elastomeric belt which extends between said longitudinally-spaced-apart rollers, said pressure being transferred to substantially the entire bottom outer area of said endless belt which is moved in intimate contact with said asphalt, whereby said asphalt is formed into a paved surface which is substantially crack-free.

* * * * *